United States Patent [19]

Edge

[11] Patent Number: 4,577,541

[45] Date of Patent: Mar. 25, 1986

[54] MUSICAL DRUM

[76] Inventor: Neil R. Edge, 487 Joralemon, Belleville, N.J. 07109

[21] Appl. No.: 739,738

[22] Filed: May 31, 1985

[51] Int. Cl.[4] ..... G10D 13/02

[52] U.S. Cl. ..... 84/411 R; D17/22; 84/420; 446/418

[58] Field of Search ..... D17/22; 84/411 R, 420; 446/418

[56] References Cited

U.S. PATENT DOCUMENTS

| | | | |
|---|---|---|---|
| 2,858,724 | 11/1958 | Troppe | 84/411 R |
| 3,509,264 | 4/1970 | Green | 84/411 R |
| 3,595,121 | 7/1971 | Magers | 84/470 R |
| 4,168,646 | 9/1979 | May | 84/411 R |
| 4,214,504 | 7/1980 | Rex | 84/411 R |

*Primary Examiner*—Lawrence R. Franklin

*Attorney, Agent, or Firm*—David A. Jackson; Daniel H. Bobis

[57] ABSTRACT

A musical drum includes a generally spherical shell of a ceramic material having a thickness less than $\frac{3}{8}$ of a inch as defining a resonant cavity therein; the shell having a bottom and an upper end; the shell being cut-out at the upper end thereof to define a first opening having a size sufficiently small to be entirely covered by the palm of a hand; the shell being cut-out, at a position between the first opening and a plane substantially mid-way between the bottom and the upper end, to define a second opening smaller than the first opening; and the shell being cut-out at a position below the plane to define a third opening for insertion of a microphone.

7 Claims, 4 Drawing Figures

MUSICAL DRUM

BACKGROUND OF THE INVENTION

This invention relates generally to musical instruments and, more particularly, is directed to a novel musical drum.

Drums have been widely used as musical instruments since at least as early as prehistoric times. Although drums have taken various configurations, for the most part, drums have taken a generally cylindrical shape with the upper end thereof open and covered with a thin elastic membrane, for example, as shown in U.S. Pat. Nos. 4,134,324 and 4,184,407.

Conventional drums, however, generally do not constitute a whole chromatic instrument, that is, an instrument capable of producing musical sounds in the entire chromatic range. Further, with conventional drums, a musical note can generally not be sustained for different amounts of time, and cannot generally produce a reverberating sound.

OBJECTS AND SUMMARY OF THE INVENTION

Accordingly, it is an object of the present invention to provide a novel musical drum which can be played in the entire chromatic range.

It is another object of the present invention to provide a novel musical drum having a first opening at its extreme upper end and a second, smaller opening positioned lower than the first opening, whereby different sounds and pitches can be produced when the drum is rubbed, hit, tapped and the like.

It is still another object of the present invention to provide a novel musical drum which can sustain a note for different, desired amounts of time.

It is yet another object of the present invention to provide a novel musical drum which can produce a reverberating sound.

It is a further object of the present invention to provide a novel musical drum that allows for amplification by a microphone.

It is a still further object of the present invention to provide a novel musical drum that is relatively easy and inexpensive to manufacture.

In accordance with an aspect of the present invention, a musical drum comprises a generally spherical shell defining a resonant cavity; the shell having a bottom and an upper end; the shell being cut-out at the upper end thereof to define a first opening; and the shell being cut-out, at a position between the first opening and a plane substantially midway between the bottom and the upper end, to define a second opening smaller than the first opening.

In accordance with another aspect of the present invention, the shell is cut-out at a position below the plane to define a third opening for insertion of a microphone.

The above, and other, objects, features and advantages of the present invention, will become readily apparent from the following detailed description thereof which is to be read in connection with the accompanying drawings.

DETAILED DESCRIPTION OF A PREFERRED EMBODIMENT

Figure 1:
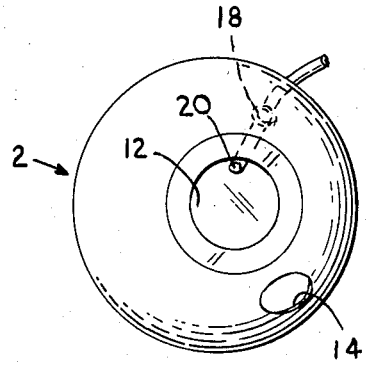
FIG. 1 is a top plan view of a musical drum according to the present invention.
Figure 2:
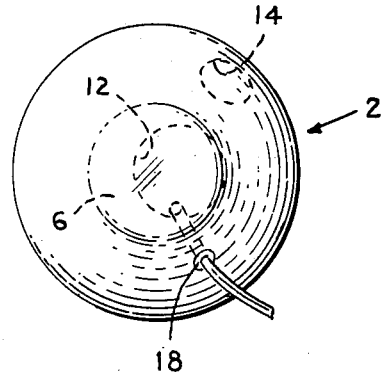
FIG. 2 is a bottom plan view of the musical drum of FIG. 1.

Referring to the drawings in detail, a musical drum 2 according to the present invention is comprised of a generally spherical shell 4 defining a resonant cavity therein. It will be appreciated that shell 4 is not a true sphere and may, for example, be slightly elongated. Preferably, shell 4 has a slight incline or offset in order to produce better quality sounds, particularly during amplification.

Figure 3:
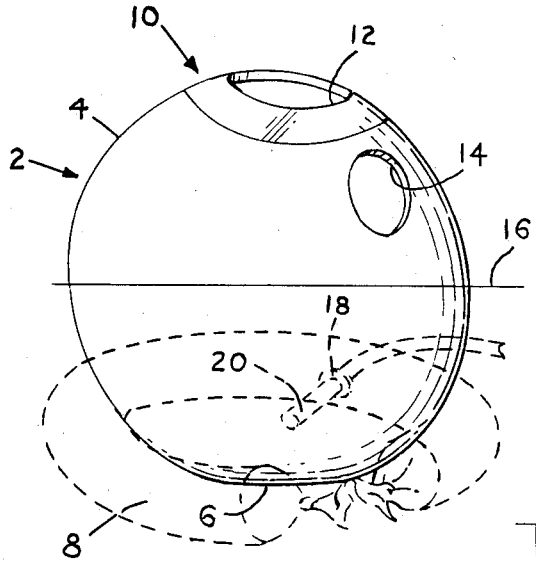
FIG. 3 is a perspective view of the musical drum of FIG. 1, viewed from the front thereof.
Figure 4:
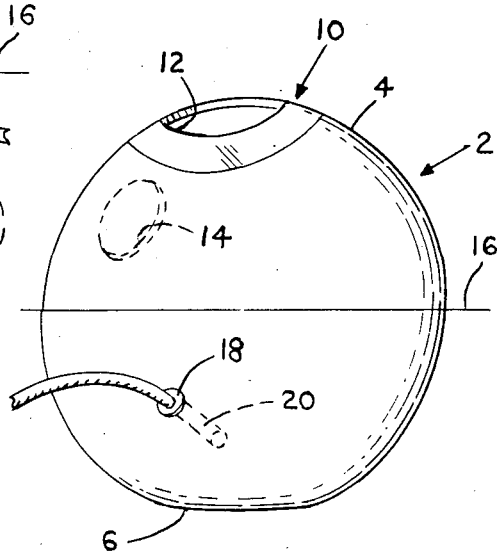
FIG. 4 is a perspective view of the musical drum of FIG. 1. viewed from the rear thereof.

Shell 4 preferably has a flat bottom 6 by which it can easily rest on the ground. Alternatively, bottom 6 may be of an arcuate or rounded shape, whereupon drum 2 can sit upon a base, such as base 8 shown in FIG. 3. Base 8 may be an elongated sack which can be filled with sand, rice, or other loose consistency material which can be tied at its ends and then formed in a circular configuration, as shown in FIG. 1.

At the upper end 10 of shell 4, that is, opposite base or bottom 6, shell 4 is cut-out to define a first opening 12. Preferably, first opening 12 has a circular configuration and is sufficiently small to be entirely covered by the palm of a hand.

Shell 4 is further cut-out to define a second, smaller circular opening 14 positioned between first opening 12 and a plane 16 substantially mid-way between the bottom 6 and upper end 10.

Preferably, shell is made of a ceramic material having a thickness less than $\frac{3}{8}$ of an inch and made by a conventional slip casting method. However, other materials such as bronze, porcelain, plastic, clay, stoneware and the like can be used in addition to, or as a substitute for, the ceramic material.

In use, the user or player places each opened hand above a respective opening 12 or 14 and hits the drum 2 thereat. The openings are positioned so that it is comfortable to play the instrument. As each hand hits the drum above a respective opening, air is pushed within the drum to provide a drum-like sound. Generally, the larger opening 12 is hit with the palm of the hand, while the hitting of the smaller opening 14 varies from finger to palm.

Different sounds and pitches will be produced depending upon which opening is covered when the drum is hit and the portion of each opening that is covered by the hand when the drum is hit. Generally, the larger opening produces a lower sound, while hitting the smaller opening produces a higher pitch sound. It is therefore important that the opening 14 be smaller in dimension than opening 12.

Further, variations in the tonal quality results, depending upon the position of opening 14, that is, whether it is closer to opening 12 or closer to plane 16. Further, as well known with conventional drums, the larger the resonant cavity defined within shell 4, the deeper the sound.

With the present instrument, the entire range of the chromatic scale can be played, depending upon the portion of each opening that is covered by the hand.

Further, with the present invention, a note can be sustained by holding the hand in a covering position to the respective opening after drum 2 is hit. In addition, a reverberating or "wawa" sound can be produced by vibrating the hand as it is moved away from the drum after the drum is struck.

The pitch of the drum can be readily controlled by filling the inside of shell 4 with material, whereby the volume of sound is reduced, while the pitch is raised. For example, a clay or clay-like material can fill the bottom of shell 4 within the resonant cavity.

Still further, the drum can be rubbed, tapped, and the like, in addition to striking the drum with an open hand, to produce still further sounds, such as a pinging sound, a ringing sound and the like. Also, a scratch pad can be placed on the outside of the drum to produce a still more varied sound.

In accordance with another aspect of the present invention, shell 4 is cut-out at a portion adjacent bottom 6 to define a third opening 18 for insertion of a microphone 20. The microphone may be any suitable microphone, such as a Shure 570 dynamic, low impedance microphone, a Sony E150 microphone, or the like. The microphone is held within opening 18 by wax or clay so as to close the opening entirely.

Thus, in accordance with the present invention, a novel musical drum is provided which enables the player to produce notes within the entire chromatic range, while also providing additional features such as reverberation, sustaining of notes and the like.

Having described a specific preferred embodiment of the invention with reference to the accompanying drawings, it is to be understood that the present invention is not limited to that precise embodiment, and that various changes and modifications may be effected therein by one of ordinary skill in the art without departing from the scope or spirit of the invention as defined by the appended claims.

What is claimed is:

1. A musical drum comprising:

a generally spherical shell defining a resonant cavity;

said shell having a bottom and an upper end;

said shell being cut-out at said upper end thereof to define a first opening; and said shell being cut-out, at a position between said first opening and a plane substantially mid-way between said bottom and said upper end, to define a second opening smaller than said first opening.

2. A musical drum according to claim 1; wherein said shell is made from at least one material from the group of ceramic, brass and stoneware.

3. A musical drum according to claim 1; wherein said shell is cut-out at a position below said plane to define a third opening for insertion of a microphone.

4. A musical drum according to claim 3; wherein said third opening has an essentially circular configuration.

5. A musical drum according to claim 1; wherein said first opening has an essentially circular configuration.

6. A musical drum according to claim 1; wherein said second opening has an essentially circular configuration.

7. A musical drum according to claim 1; wherein the size of said first opening is sufficiently small to be entirely covered by the palm of a hand.

* * * * *